US008100731B2

(12) United States Patent
Koyama et al.

(10) Patent No.: US 8,100,731 B2
(45) Date of Patent: Jan. 24, 2012

(54) ELECTRIC CONNECTOR, ELECTRONIC DEVICE, AND ELECTRICALLY-CONDUCTIVE TOUCH METHOD

(75) Inventors: Jiro Koyama, Otsu (JP); Hirotada Teranishi, Kusatsu (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 13/006,400

(22) Filed: Jan. 13, 2011

(65) Prior Publication Data

US 2011/0177725 A1 Jul. 21, 2011

(30) Foreign Application Priority Data

Jan. 15, 2010 (JP) ..... 2010-007138

(51) Int. Cl.
*H01R 4/48* (2006.01)

(52) U.S. Cl. ..... 439/862; 439/504; 439/733.1

(58) Field of Classification Search ..... 439/500, 439/504, 733.1, 759, 862
See application file for complete search history.

(56) References Cited

U.S. PATENT DOCUMENTS

| | | | | |
|---|---|---|---|---|
| 2010/0136850 | A1 | 6/2010 | Inaba et al. | |
| 2011/0177725 | A1 * | 7/2011 | Koyama et al. | 439/759 |
| 2011/0201217 | A1 * | 8/2011 | Koyama et al. | 439/83 |

FOREIGN PATENT DOCUMENTS

| | | |
|---|---|---|
| EP | 1965469 | 9/2008 |
| JP | 2008-153107 | 7/2008 |
| JP | 2008-218035 | 9/2008 |

* cited by examiner

*Primary Examiner* — James Harvey
(74) *Attorney, Agent, or Firm* — Osha • Liang LLP

(57) ABSTRACT

An electric connector has a contact spring. The contact spring includes a fixed portion that is retained by a housing, an involute portion that is extended from the fixed portion into an inward spiral pattern, a revolute portion that is inverted from the involute portion and extended into an outward spiral pattern along the involute portion, an arm portion that is connected to a tail end portion of the revolute portion, a tangential direction of a portion connected to the revolute portion in the arm portion being aligned with a tangential direction of the tail end portion of the revolute portion, and a contact portion that is provided at a leading end of the arm portion to be projected to an outside of the housing, the contact portion abutting on the-other-end electrode to receive a pressing force in a direction in which the arm portion is substantially extended.

7 Claims, 5 Drawing Sheets

ELECTRIC CONNECTOR, ELECTRONIC DEVICE, AND ELECTRICALLY-CONDUCTIVE TOUCH METHOD

BACKGROUND OF THE INVENTION

1. Technical Field

The present invention relates to an electric connector, an electronic device, and an electrically-conductive touch method.

2. Related Art

Various electric connectors are used in the electronic device. Among others, it is necessary that the electric connector that gets into electrically-conductive touch with an electrode of a battery have a large displacement amount so as to be able to absorb not only a dimension error of the electric connector or a deviation of a mounting position but also a dimension error of a chassis or the battery of the electronic device.

Because occasionally the battery is moved in the chassis of the electronic device, unless a contact pressure of a contact spring is sufficiently increased, there is a possibility of generating temporary blackout in which the electric touch of the contact spring with the electrode of the battery is instantaneously lost. For example, the mobile telephone is powered off when the temporary blackout is generated in a mobile telephone in a standby state, and incoming processing cannot be performed unless the mobile telephone is powered on again.

In the electronic device such as the mobile telephone, there is a demand to reduce dimensions of the electric connector in order to realize the miniaturization of the device. Although the contact spring is shortened when the electric connector is simply miniaturized, a bending deformation amount of the contact spring is increased, and a partially large stress is concentrated. When the applied stress exceeds an elastic limit, the contact spring is plastically deformed to generate so-called wear in which a displacement amount or a contact pressure of the contact is lost. Because the stress concentration is relaxed when the contact spring is thinned, the plastic deformation is hardly generated. However, the elastic force is decreased due to the thinned contact spring, and a contact pressure of the contact is decreased.

For example, in order to solve the trouble, Japanese Unexamined Patent Publication No. 2008-218035 discloses a battery connecting electric connector in which the contact spring snakes into a substantial S-shape. However, wear is easily generated when the electric connector is miniaturized.

Japanese Unexamined Patent Publication No. 2008-153107 discloses a connector in which the contact spring is formed into a roll shape. However, the size in the width direction of the contact spring is increased because the contact spring is partially overlapped in a width direction in order to cylindrically wind the contact spring up to 360° or more.

SUMMARY

One or more embodiments of the present invention provides a compact electric connector and a compact electronic device, in which the contact has the high contact pressure and the large displacement amount, and an electrically-conductive touch method in which an occupied space is reduced.

In accordance with one aspect of the present invention, an electric connector includes a contact spring, wherein the contact spring includes a fixed portion that is retained by a housing, an involute portion that is extended from the fixed portion into an inward spiral pattern, a revolute portion that is inverted from the involute portion and extended into an outward spiral pattern along the involute portion, an arm portion that is connected to a tail end portion of the revolute portion, a tangential direction of a portion connected to the revolute portion in the arm portion being aligned with a tangential direction of the tail end portion of the revolute portion, and a contact portion that is provided at a leading end of the arm portion to be projected to an outside of the housing, the contact portion abutting on the-other-end electrode to receive a pressing force in a direction in which the arm portion is substantially extended.

With this configuration, the contact spring is formed into the double spiral shape to increase a length of the contact spring with respect to the occupied space. When the pressing force of the-other-end electrode acts in the tangential direction of the spiral, the pressing force propagates as a compressive stress or a tensile stress along the extended direction of the contact spring, and the pressing force acts so as to wind or rewind the contact spring. Therefore, the bending stress acts on the whole of the involute portion and revolute portion of the contact spring in the dispersed manner, and the bending stress is not locally concentrated, so that a risk of plastically deforming the contact spring can be eliminated to secure the large contact pressure and displacement amount compared with the dimensions of the contact spring.

In the electric connector according to one or more embodiments of the present invention, the arm portion may be formed in a direction identical to that of the revolute portion into a bow shape that is curved with a curvature larger than that of the revolute portion.

With this configuration, the bend of the arm portion also contributes to the displacement amount of the contact portion. When the contact portion is pushed with respect to the-other-end electrode, the contact portion is moved in the direction orthogonal to the pressing direction of the-other-end electrode to obtain a wiping effect that removes adhesives to the contact portion and the-other-end electrode.

In the electric connector according to one or more embodiments of the present invention, the arm portion may include an escape portion that snakes in a direction different from the tangential direction of the tail end portion of the revolute portion.

With this configuration, the buckling of the arm portion can be prevented by the deformation of the escape portion.

In the electric connector according to one or more embodiments of the present invention, the housing may include a guide portion that guides at least one of the arm portion and the contact portion to the tangential direction of the revolute portion.

With this configuration, the pressing force of the-other-end electrode can correctly be transmitted in the tangential direction of the spiral to the outside end portion of the revolute portion.

In the electric connector according to one or more embodiments of the present invention, an end portion on a side located farther away from the arm portion may be extended to an inside of the housing in the contact portion.

With this configuration, the oscillation of the contact portion is prevented to smoothly secure the elastic deformation of the contact spring, so that the contact pressure can sufficiently be realized.

In accordance with another aspect of the present invention, an electronic device includes any of the electric connectors described above, wherein a battery is mounted, and an electric power is supplied from the battery through the contact spring of the electric connector.

With this configuration, because the electric connector has the high contact reliability with respect to the electrode of the battery, the electric power is securely supplied to the electronic device, and the electronic device is securely operated.

In accordance with still another aspect of the present invention, an electrically-conductive touch method includes providing an electric connector that includes a contact spring, the contact spring including a fixed portion that is retained by a housing, an involute portion that is extended from the fixed portion into an inward spiral pattern, a revolute portion that is inverted from the involute portion and extended into an outward spiral pattern along the involute portion, an arm portion that is substantially extended from the revolute portion in a tangential direction of the revolute portion, and a contact portion that is provided at a leading end of the arm portion and projected to an outside of the housing, abutting the-other-end electrode on the contact portion, and pushing the contact portion in the direction in which the arm portion is extended.

With this method, the pressing force propagates as the compressive stress or the tensile stress along the extended direction of the contact spring, but the stress is not locally concentrated, so that the electrically-conductive touch can securely be achieved while both the high contact pressure and the large displacement amount are established.

DETAILED DESCRIPTION

Figure 1:
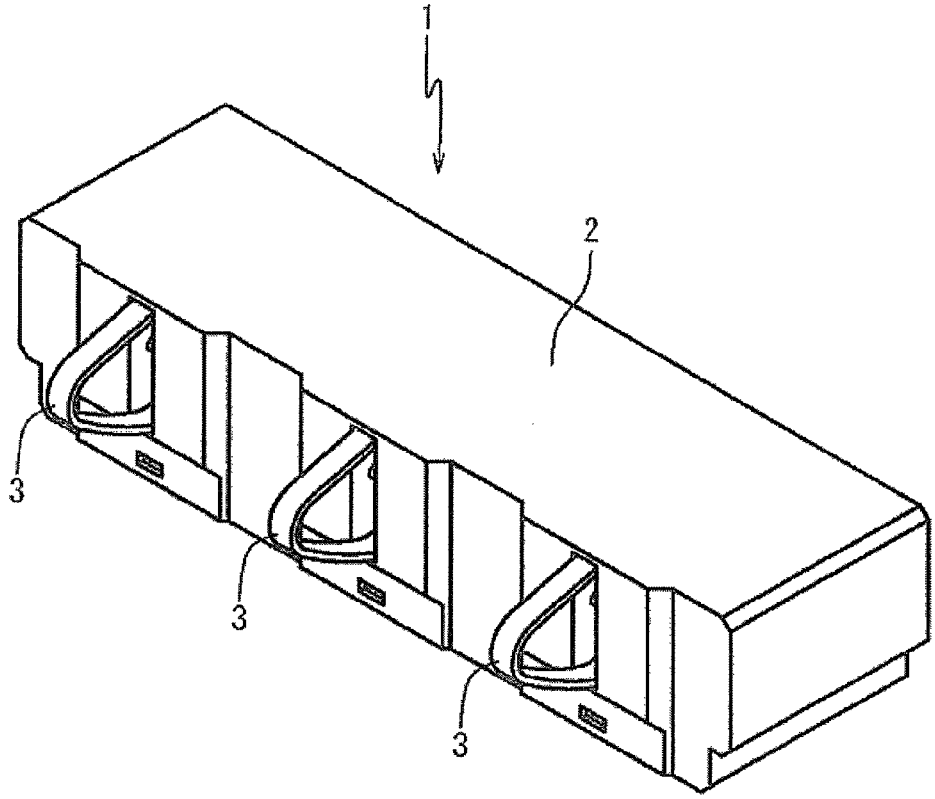
FIG. 1 is a perspective view of an electric connector according to a first embodiment of the present invention.

Hereinafter, embodiments of the present invention will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. FIG. 1 is a perspective view of a battery connecting electric connector 1 according to a first embodiment of the present invention. In the electric connector 1, contact springs 3 are inserted in and fixed to three slots formed in a housing 2, respectively.

In the three contact springs 3, the central contact spring 3 is used as a control contact, and each of the contact springs 3 located on both sides is used as a contact that gets into touch with an electrode (the-other-end electrode) of a battery in order to supply a power. When the power supplying contact is formed by a pair of contacts, reliability of electrically-conductive touch with the-other-end electrode is improved.

Figure 2:
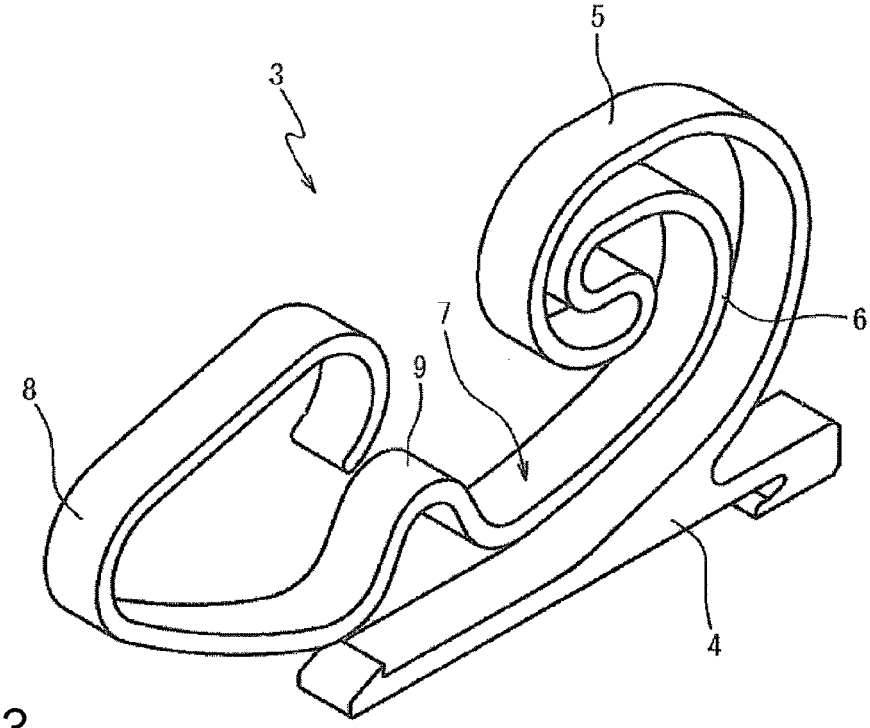
FIG. 2 is a perspective view illustrating a contact spring of the electric connector of FIG. 1.
Figure 3:
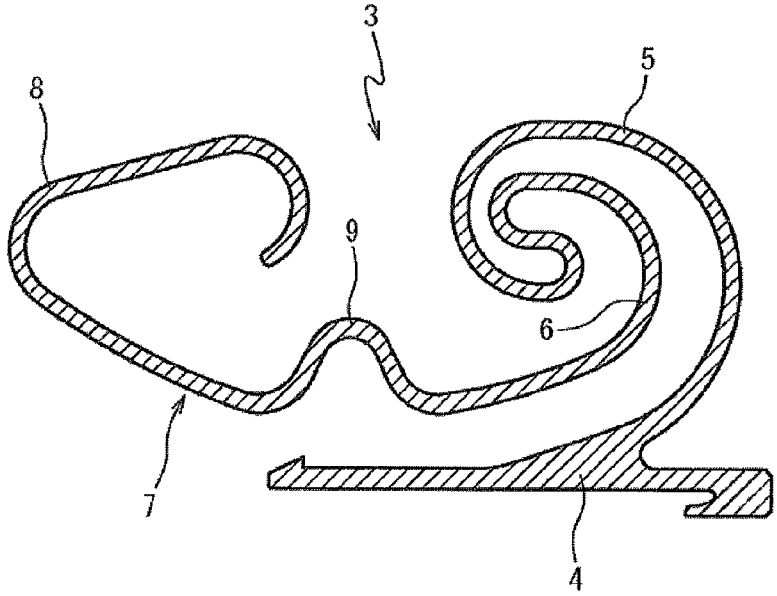
FIG. 3 is a sectional view of the contact spring of FIG. 2.

FIGS. 2 and 3 illustrate a shape of the contact spring 3. The contact spring 3 is a plate spring that includes a fixed portion 4, an involute portion 5, a revolute portion 6, an arm portion 7, and a contact portion 8. The fixed portion 4 is retained by the housing 2. The involute portion 5 is extended toward a center of a spiral from the fixed portion 4 so as to draw a spiral pattern. The revolute portion 6 is inverted from the involute portion 5 near the center of the spiral and extended outward so as to draw the spiral pattern along the involute portion 5. The arm portion 7 is continuously extended in a substantially tangential direction of the spiral from the revolute portion 6. The contact portion 8 is formed at a leading end of the arm portion 7, the contact portion 8 is projected to the outside of the housing 2 to be able to get into touch with the electrode of the battery, the contact portion 8 is folded back so as to draw an arc, and the leading end of the contact portion 8 is extended into the slot of the housing 2.

The arm portion 7 is formed such that a tangential direction of a portion that is in touch with the revolute portion 6 is aligned with a tangential direction of a tail end of the revolute portion 6. The arm portion 7 is curved in the same direction as the revolute portion 6 with a curvature that is considerably larger than that of the revolute portion 6, and the arm portion 7 is formed into a bow shape that is substantially convex downward. In other words, the arm portion 7 is formed such that the portion continuously formed from the revolute portion 6, that is, the portion near the tail end portion of the revolute portion 6 is substantially aligned with the tangential direction in the tail end portion of the revolute portion 6, and the arm portion 7 is extended such that the leading end of the arm portion 7 is sufficiently separated from the revolute portion 6. An escape portion 9 is formed in a central portion of the arm portion 7. In the escape portion 9, the arm portion 7 is extended upward once by straying largely from the tangential direction of the tail end portion of the revolute portion 6, and the arm portion 7 snakes so as to return to an extended line of the original bow shape.

Figure 4:
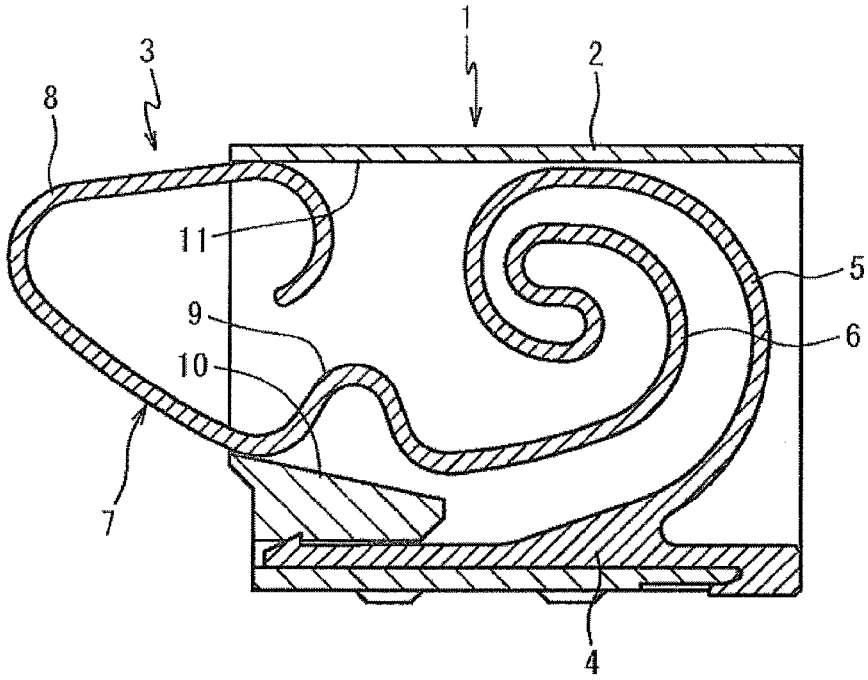
FIG. 4 is a sectional view illustrating an initial state of the electric connector of FIG. 1.

FIG. 4 illustrates a section of the electric connector 1 in an initial state in which the electric connector 1 does not abut on the electrode of the battery. In the contact spring 3, then the fixed portion 4 is inserted in and fixed to the housing 2, the leading ends of the arm portion 7 and contact portion 8 are projected from an opening in a front face of the housing 2. However, the contact portion 8 is extended such that the leading end portion opposite to the arm portion 7 is located in the housing 2.

The arm portion 7 abuts on a lower-side guide 10 formed in the slot of the housing 2 while the contact spring 3 is inserted in the housing 2, and the arm portion 7 slightly pushes up the contact portion 8. Therefore, the contact portion 8 abuts on an upper-side guide 11 formed by an upper wall of the housing 2.

Figure 5:
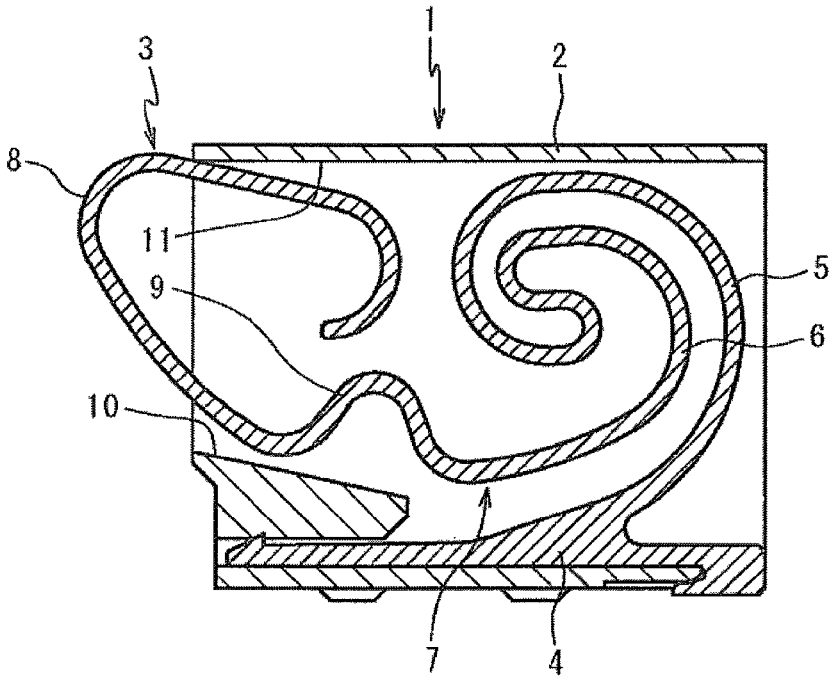
FIG. 5 is a sectional view illustrating a state in which the contact spring of the electric connector of FIG. 1 is being pushed into.
Figure 6:
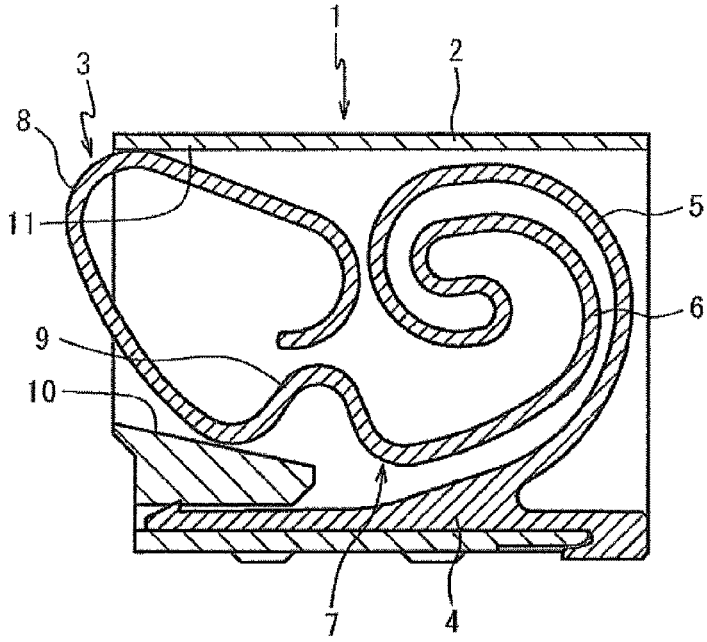
FIG. 6 is a sectional view illustrating a state in which the contact spring of the electric connector of FIG. 1 is pushed into.

FIGS. 5 and 6 illustrate states in which the contact portion 8 is being pushed and already pushed into the housing 2 by the electrode of the battery (not illustrated). The electrode of the battery pushes the arm portion 7 in the substantially same direction as the tangential direction at the outside leading end of the revolute portion 6 while the contact portion 8 is interposed therebetween. Because the arm portion 7 is curved into the bow shape, a bending stress is applied such that both ends of the arm portion 7 come close to each other. However, because the arm portion 7 has the large curvature, the arm portion 7 exhibits a behavior close to a straight rod, and a compressive stress in the extended direction is mainly applied.

That is, although bending of the arm portion 7 also contributes to a displacement amount of the contact portion 8, the arm portion 7 mainly has a function of transmitting a pressing force acting on the contact portion 8 to the revolute portion 6 as a compressive stress in the direction that is substantially aligned with the tangential direction in the tail end of the revolute portion 6. The arm portion 7 is extended so as to recede from the revolute portion 6, and the arm portion 7 forms a space to prevent the abutment of the contact portion 8 and the involute portion 5 when the contact portion 8 is pushed as illustrated in FIG. 6.

When the excessive compressive stress is applied in the extended direction of the arm portion 7, the escape portion 9 is bent to reduce the compressive stress of the arm portion 7, and buckling of the arm portion 7 is prevented.

Because the central portion of the arm portion 7 is not moved lower than the lower-side guide 10, the arm portion 7 is gradually bent as the contact portion 8 is pushed into the housing 2, thereby upwardly moving the contact portion 8. The contact portion 8 is moved in a direction orthogonal to the pressing direction of the-other-end electrode, whereby dirt existing between the-other-end electrode and the contact portion 8 is scraped out to exert a wiping effect that secures the electric contact.

The lower-side guide 10 and the upper-side guide 11 prevent a vibration in a plate thickness direction of the arm portion 7, and the lower-side guide 10 and the upper-side guide 11 guarantee that the pressing force of the-other-end contact acts on the outside end portion of the revolute portion 6 in the tangential direction of the position of the outside end portion.

The-other-end electrode presses the contact portion 8, whereby the compressive stress applied to the arm portion 7 is transmitted in the spiral tangential direction with respect to the revolute portion 6. The compressive stress or tensile stress, which is applied in the extended direction of the spiral plate spring, propagates along the extended direction as a force to wind the plate spring or a force to rewind the plate spring rather than a force to bend the plate spring. Accordingly, in the first embodiment, the force that the-other-end electrode presses the contact portion 8 acts as the force in the direction in which the revolute portion 6 is wound and the force that pushes the involute portion 5 into the central portion of the involute portion 5 so as to rewind the involute portion 5.

That is, the force to push the contact portion 8 acts as the compressive stress in the extended direction of the contact spring 3 over the substantially total length of the contact spring 3, and only a horizontal component of the change in the stress applied direction is applied bit by bit as the bending stress in the dispersed manner to each portion of the contact spring 3.

Therefore, because the contact spring 3 mainly presses the contact portion 8 against the electrode of the battery as a reaction force of the compressive stress, the high contact pressure is obtained higher than that of the bending stress. In the contact spring 3, the direction of the compressive stress is gradually changed into the spiral shape, and the bending stress is applied bit by bit to each portion. Therefore, the large stress exceeding an elastic range is not locally applied by stress concentration, the contact spring 3 is not plastically deformed, and the contact spring 3 does not wear.

In the first embodiment, because the bending stress is applied to the fixed portion 4 of the contact spring 3, the fixed portion 4 of the contact spring 3 is thickened to suppress the bending deformation, thereby preventing the plastic deformation. Therefore, a trouble in which the housing 2 blocks the elastic deformation of the contact spring 3 to lose the contact pressure is eliminated.

When an aspect ratio (ratio of a plate width to a plate thickness) of the sectional shape of the contact spring 3 is set double or more, the contact spring 3 is not twisted by the deformation in the plate width direction, and a trouble in which the contact spring 3 is hooked by the housing 2 to disturb the exertion of the elastic force as the spring can be prevented. However, even if the aspect ratio of the contact spring 3 is set to five times or more, the further twist preventing effect is not expected, but only dimensions of the electric connector 1 are enlarged.

In the electric connector 1 of the first embodiment, the leading end of the contact portion 8 is extended to the inside of the slot of the housing 2, which prevents the contact spring 3 from oscillating to generate a deviation in the plate width direction.

Figure 7:
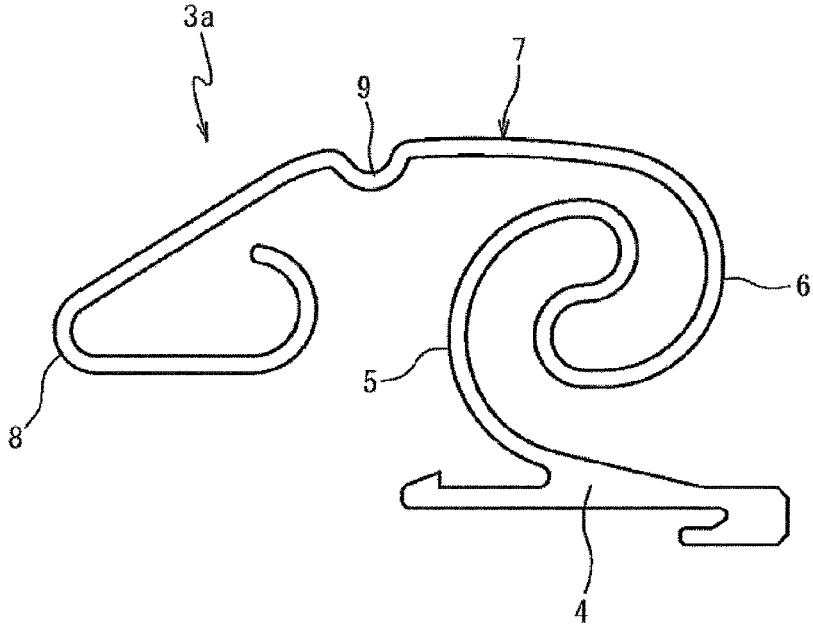
FIG. 7 is a side view illustrating a single contact spring of an electric connector according to a second embodiment of the present invention.

FIG. 7 illustrates a contact spring 3*a* of an electric connector according to a second embodiment of the present invention. In the second embodiment, the same constituents as those of the first embodiment are designated by the same reference numerals, and the overlapping description is omitted.

In the contact spring 3 of the second embodiment, the outside end portion of the revolute portion 6 is located on the opposite side to the outside end portion of the involute portion 5, that is, the arm portion 7 is located on the opposite side to the fixed portion 4 while the involute portion 5 and the revolute portion 6 are interposed therebetween. As shown in the second embodiment, when the arm portion 7 receives the compressive stress in the direction that is substantially aligned with the tangential direction in the outside end portion of the revolute portion 6, as described above, the contact pressure of the contact portion 8 is mainly generated by the compressive stress, and the compressive stress can continuously be transmitted to the involute portion 5 and the revolute portion 6.

Figure 8:
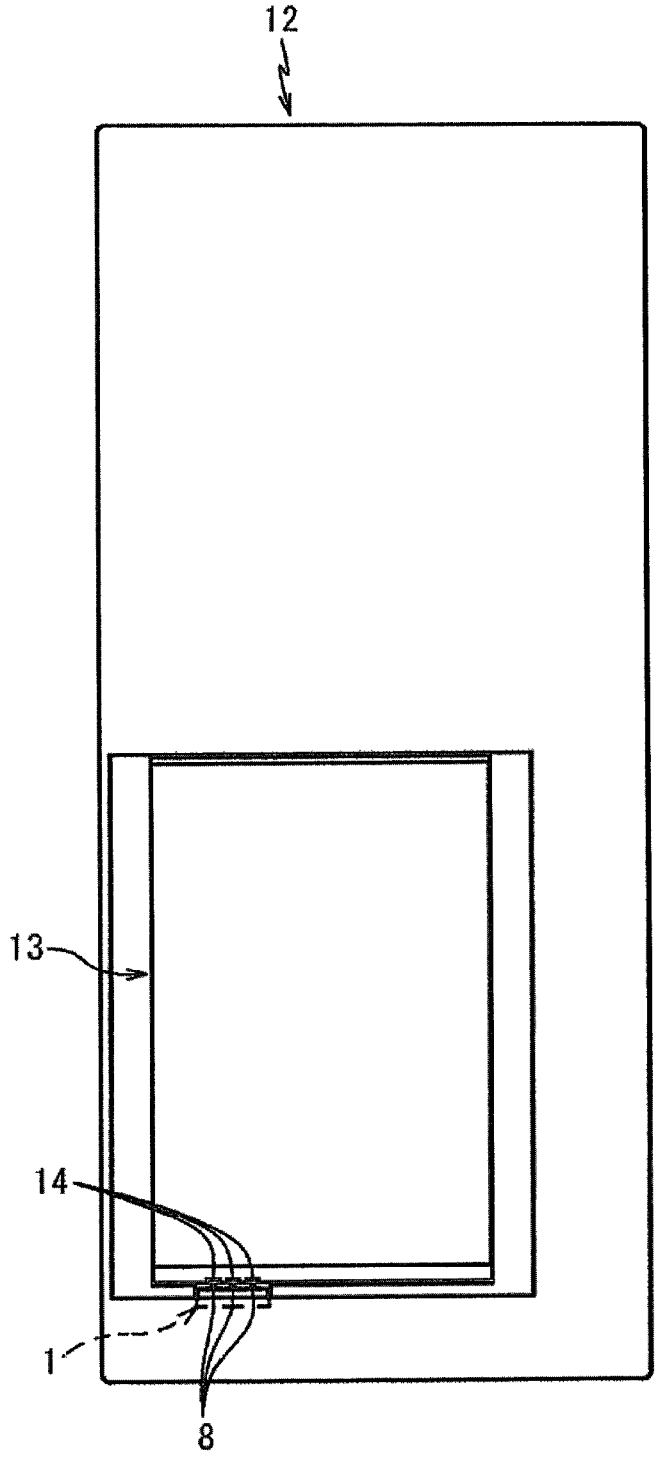
FIG. 8 is a rear view illustrating a mobile telephone provided with the electric connector of FIG. 1.

FIG. 8 illustrates a mobile telephone 12 as the electronic device according to an embodiment of the present invention provided with the electric connector 1 of the first embodiment. In the mobile telephone 12, the electric connector 1 is provided, and a battery 13 can be accommodated in a space adjacent to the electric connector 1. When the battery 13 is accommodated in the mobile telephone 12, the contact portion 8 of the electric connector 1 gets into pressure touch with an electrode 14 of the battery 13.

As described above, in the compact electric connector 1, the contact portion 8 has the large deformable amount, the contact pressure is high, and the contact spring 3 is hardly plastically-deformed. Therefore, the electric power is always supplied from the battery 13 to the main body of the mobile telephone 12, so that standby processing and the like can securely be performed.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An electric connector comprising a contact spring, wherein the contact spring includes:

a fixed portion that is retained by a housing;

an involute portion that is extended from the fixed portion into an inward spiral pattern;

a revolute portion that is inverted from the involute portion and extended into an outward spiral pattern along the involute portion;

an arm portion that is connected to a tail end portion of the revolute portion, a tangential direction of a portion in the arm portion being aligned with a tangential direction of the tail end portion of the revolute portion; and a contact portion that is provided at a leading end of the arm portion to be projected to an outside of the housing, the contact portion abutting on an electrode to receive a pressing force along a direction in which the arm portion is substantially extended.

2. The electric connector according to claim 1, wherein the arm portion is formed in a direction identical to that of the revolute portion into a bow shape that is curved with a curvature larger than that of the revolute portion.

3. The electric connector according to claim 1, wherein the arm portion includes an escape portion that snakes in a direction different from the tangential direction of the tail end portion of the revolute portion.

4. The electric connector according to claim 1, wherein the housing includes a guide portion that guides at least one of the arm portion and the contact portion to the tangential direction of the revolute portion.

5. The electric connector according to claim 1, wherein an end portion on a side located farther away from the arm portion is extended to an inside of the housing in the contact portion.

6. An electronic device comprising the electric connector according to claim 1, wherein a battery is mounted, and an electric power is supplied from the battery through the contact spring of the electric connector.

7. An electrically-conductive touch method comprising:

providing an electric connector that includes a contact spring, the contact spring including:

a fixed portion that is retained by a housing;

an involute portion that is extended from the fixed portion into an inward spiral pattern;

a revolute portion that is inverted from the involute portion and extended into an outward spiral pattern along the involute portion;

an arm portion that is substantially extended from the revolute portion in a tangential direction of the revolute portion; and a contact portion that is provided at a leading end of the arm portion and projected to an outside of the housing, abutting an electrode with the contact portion; and pushing the contact portion along the direction in which the arm portion is extended.

* * * * *